United States Patent [19]

Bonnell et al.

[11] 4,007,715

[45] Feb. 15, 1977

[54] ROTARY ENGINES, COMPRESSORS AND VACUUM PUMPS

[75] Inventors: Robert Peter Bonnell, West Beach; Arthur Douglas Northey, Labrador, both of Australia

[73] Assignee: Fairey Norbon Pty. Ltd., Adelaide, Australia

[22] Filed: Mar. 24, 1975

[21] Appl. No.: 561,555

[30] Foreign Application Priority Data

Mar. 28, 1974 Australia ..... 7066/74

[52] U.S. Cl. ..... 123/8.43; 418/179; 418/196

[51] Int. Cl.[2] ..... F02B 53/00

[58] Field of Search ..... 123/8.25, 8.93; 418/191, 196

[56] References Cited

UNITED STATES PATENTS

| | | | |
|---|---|---|---|
| 54,006 | 4/1866 | Norton | 418/191 |
| 1,046,280 | 12/1912 | Diefenderfer | 123/8.43 |
| 2,766,737 | 10/1956 | Sprinzing | 123/8.43 X |
| 2,920,610 | 1/1960 | Breelle | 418/196 X |
| 3,811,804 | 5/1974 | Roth et al. | 418/191 X |
| 3,895,609 | 7/1975 | Armstrong | 123/8.41 |

FOREIGN PATENTS OR APPLICATIONS

| | | | |
|---|---|---|---|
| 223,128 | 6/1910 | Germany | 123/8.43 |
| 604,972 | 7/1948 | United Kingdom | 418/7 |

*Primary Examiner*—Carlton R. Croyle
*Assistant Examiner*—Michael Koczo, Jr.
*Attorney, Agent, or Firm*—Jay L. Chaskin

[57] ABSTRACT

A rotary machine useful as a rotary compressor or engine having a cylindrical compressor rotor with a lobe outstanding from its cylindrical rolling surface geared to another cylindrical rotor with a recess, in its cylindrical rolling surface, the rotors being rotatable within respective parallel intersecting cylinders of a stator so that the lobe sweeps its stator cylinder and meshes with the recess as it moves past the other rotor.

The lobe and recess are of such complementary shape that the lobe more than half fills the recess while still contiguous with its cylinder and the leading face of the lobe is contiguous with the leading surface of the recess after separation of the rolling surface so that the gases entrapped in the recess are of minimum quantity, and are released from the recess back into the cylinder but behind the trailing surface of the lobe.

12 Claims, 14 Drawing Figures

ROTARY ENGINES, COMPRESSORS AND VACUUM PUMPS

This invention relates to a rotary machine of the so-called rotary abutment type, which machine may be used as a rotary engine, compressor or vacuum pump.

BACKGROUND OF THE INVENTION

Many machines of the rotary abutment type have been proposed heretofore, and some such machines have been suggested for use as rotary engines, but in practice their use has been isolated to either pumps or liquid operated motors (for example oil motors).

Rotary abutment machines comprise many types, from simple gear pumps or motors to sliding vane pumps or motors and included amongst the types which have been proposed but which are not in general use, is a rotary machine which may be defined as follows:

A plurality of rotors rotatable within respective parallel intersecting bores in a stator, at least one of said rotors being a compression rotor and having an axially extending lobe radially outstanding therefrom, which upon rotation, sealably co-operates with the curved surface of its respective said bore, another said rotor being a gas transfer rotor and having a rolling surface in gas sealing contiguity with the curved surface of its respective bore and containing an axially extending gas transfer recess which extends radially inward from its rolling surface, and drive means coupling the compression rotor to rotate in one direction and the gas transfer rotor to rotate in the opposite direction, the axes of the rotors being arranged so that, upon rotation, the recess surface is entered by said lobe, and when the lobe is not within the recess, the rolling surface of the compression rotor lies in gas sealing contiguity with the rolling surface of the gas transfer rotor. Said machine was the subject of British Patent 560987 (Everleigh) which is discussed below.

There are theoretical advantages to be achieved over piston engines for example, but these advantages have heretofore not been fulfilled. One advantage is that a more effective use is made of the thrust from expanding gases against a lobe. In a piston engine, both the induction and compression strokes are short in relation to the complete cycle whereas with a rotary abutment type machine the strokes are relatively long. A higher degree of expansion can be attained with a long stroke rotary abutment type machine, thereby utilizing the characteristics of expanding gases. In some piston engines, the exhaust gases are not completely swept out of the working chamber. In all piston engines, special dynamic balancing methods are required to reduce vibration. The highest speed attainable from a piston engine under good working conditions is about 6,000 rpm, although higher speeds have been attained for special purposes. A piston engine is characterised by many rubbing and frictional surfaces required to seal the working chamber, and also by considerable windage of the working parts. Much power loss results from these disabilities. Since a piston engine has its piston moving at a relatively low speed when ignition takes place, an exhaust gas is produced which includes oxides of nitrogen, unburnt hydrocarbons, other undesirable polluting gases and particulates (oil smoke etc.).

In the British Patent No. 560987 issued to E. F. Everleigh there was proposed a rotary abutment type machine of the above defined type having two compression rotors, two power rotors and one gas transfer rotor, wherein the outermost rotors and the intermediate rotor were all of frusto conical shape, and provision was made for axial movement of the intermediate rotor. The outer surfaces of the chambers had ends which were of curved shape in cross-section, whereas the recess of the rotor extended for the full length of the rotor, thus providing excessive leakage paths. For this reason the engine could only be suitable for very high speed operation, as for example would be associated with gas flow speeds utilised in gas turbines. However the surfaces of the intermediate and outer rotors were urged into firm contact, there being a resultant rubbing speed between the surfaces which would impart undesirable loading to the machine and reduce possibility of such high speeds. The most important disabilities with the engine described in that Patent specification however, were firstly the difficulty in disposing of gases entrapped in the intermediate rotor recess by the lobes of other rotors (assuming that they could be modified and shaped to be workable), such gas essentially being ejected in contra-flow to the induced gases of the engine; and secondly, the poor cross-sectional shape of the recess which limits gas flow between the chambers.

In the British Patent No. 1,355,254 issued to J. Koltermann et al there was described a four rotor machine, there being three outer rotors and one intermediate rotor, and the machine being described as one useful for operating as an engine on compresed gas. The cross-sectional shape of lobe and recess was such as to entrap quantities of gas which again would be injected in contra-flow to the induction, and the recess does not otherwise perform a gas transfer function, axial ports being utilised.

In British Patent No. 1,177,593 issued to K. Lauer there was described and illustrated a three rotor machine wherein the V-section lobes co-operated with a circularly curved recess in an intermediate rotor, but it will be seen that contiguity between load tip and recess surface is lost during a critical portion of the rotation, and the device is limitied to hydraulic applications.

In British specification Nos. 604,972 and 610,068 both issued to Renolds Metals Company there was described an hydraulic machine utilizing two rotors, one having a lobe thereon, and the other having a recess, but contiguity of the lobe and recess surfaces again is lost during critical periods of rotation. A further British specification No. 725,823 issued to F. Berry illustrated a machine wherein there is absence of critical contiguity between the lobe and recess. These devices are not presented as suitable for used with compressible fluids.

Similarly said critical contiguity is lost in the British Patent No. 754,984 issued to Liquid Control Corporation, being a liquid transfer metering device for liquids, wherein there is no compression.

In the British Patent No. 784,554 there was described a rotary engine having lobes with involute surface cooperable with arcuate surfaces of recesses in an intermediate member, without any gas transfer function by the recess, again there being a loss of critical contiguity.

In order for a rotary abutment machine to have a reasonable output, (when used as a compressor or as an engine) it is necessary to maximise the lobe effective area. In practical engines much difficulty is encountered in achieving a design wherein a reasonably high compression ratio exists, wherein there is a smooth streamlined gas flow so that high rotational velocities can be achieved, and wherein there is a minimum of gas entrapped between lobe and recess. It should be noted that the problems encountered in an engine are much different from those encountered in hydraulic machines, some examples of which have been referred to above, because of gas compressibility. For example, we have found that a generated involute tooth form results in the entrapping of a relatively large volume of high pressure gas between the surfaces of the lobe and recess, and thereby also reducing the pressure which could be obtained if this volume was further reduced when this gas is released, it has a deleterious effect upon the induction of gases into the compressor portion of the machine. Under normal conditions the gas will be released towards the induction portion and will greatly reduce the free inward flow of gases into the induction space, of the compression cylinder.

Although the machine of this invention may be used as a compressor or as a vacuum pump, its normal use is that of a rotary engine, and the terminology used herein will assume such use. The necessary changes in structure for use as a compressor or vacuum pump will either be explained hereunder or will be obvious to those skilled in the art.

BRIEF SUMMARY OF THE INVENTION

Briefly in this invention a machine of the rotary abutment type defined herein is provided with a compression lobe which more than half fills the gas transfer recess while still contiguous with its cylinder, and the rotor faces remain in gas-sealing contiguity. This is achieved by the cross-sectional shape of the leading and radially outer surfaces of the compression lobe being curved to a shape which is approximate complementary to that of the recess walls so that the surfaces of the compression lobe move into contiguity with the recess walls upon rotation and thereby entraps a minimum of fluid, which entrapped fluid (upon further rotation) is released rearwardly past the trailing surface of the compression lobe and into the fluid induction space of the compression cylinder. This latter effect is obtained by arranging the leading face of the compression lobe to remain in gas sealing contiguity with the leading surface of the recess after separation of the rolling surfaces.

By releasing the gases in a rearward direction they would need to travel the entire circumferential length of the induction space to interfere with the free induction of fresh gases. However the fresh gases are at that stage travelling in the opposite direction and are under sub-atmospheric pressure, so that there is very little practical loss due to release of entrapped gases.

More specifically, the invention relates to a rotary machine of the abutment type as defined herein, and is characterised in that the compression lobe and the gas transfer recess are of such complementary shape that the compression lobe more than half fills the recess while still contiguous with its cylinder, and the leading face of the compression lobe remains in gas-sealing contiguity with the leading surface of the recess after separation of the rolling surfaces.

BRIEF DESCRIPTION OF THE DRAWINGS

Embodiments of the invention are described hereunder in some detail with reference to and are illustrated in the accompanying drawings in which.

DETAILED DESCRIPTION OF THE PREFERRED EMBODIMENTS

Figure 7:
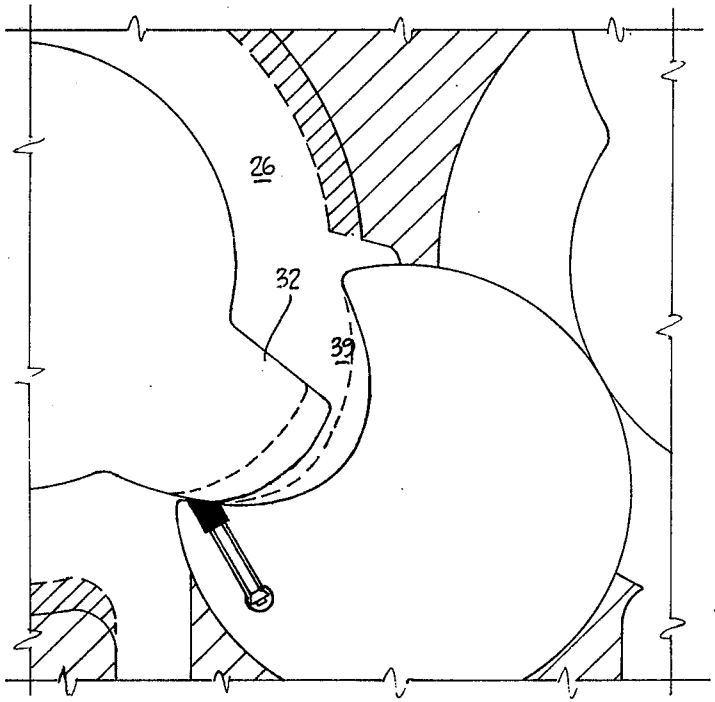
FIG. 7 illustrates a slight variation of the above embodiment wherein the diameter of the combustion cylinder is increased and the radial length of the combustion lobe is similarly increased.
Figure 8:
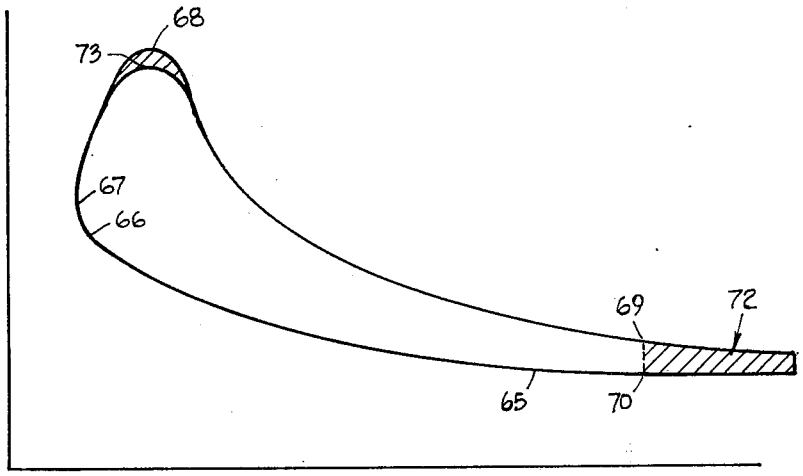
FIG. 8 is a Pressure-Volume diagram similar to FIG. 6 but showing the improvement in efficiency utilizing the configuration of FIG. 7.
Figure 9:
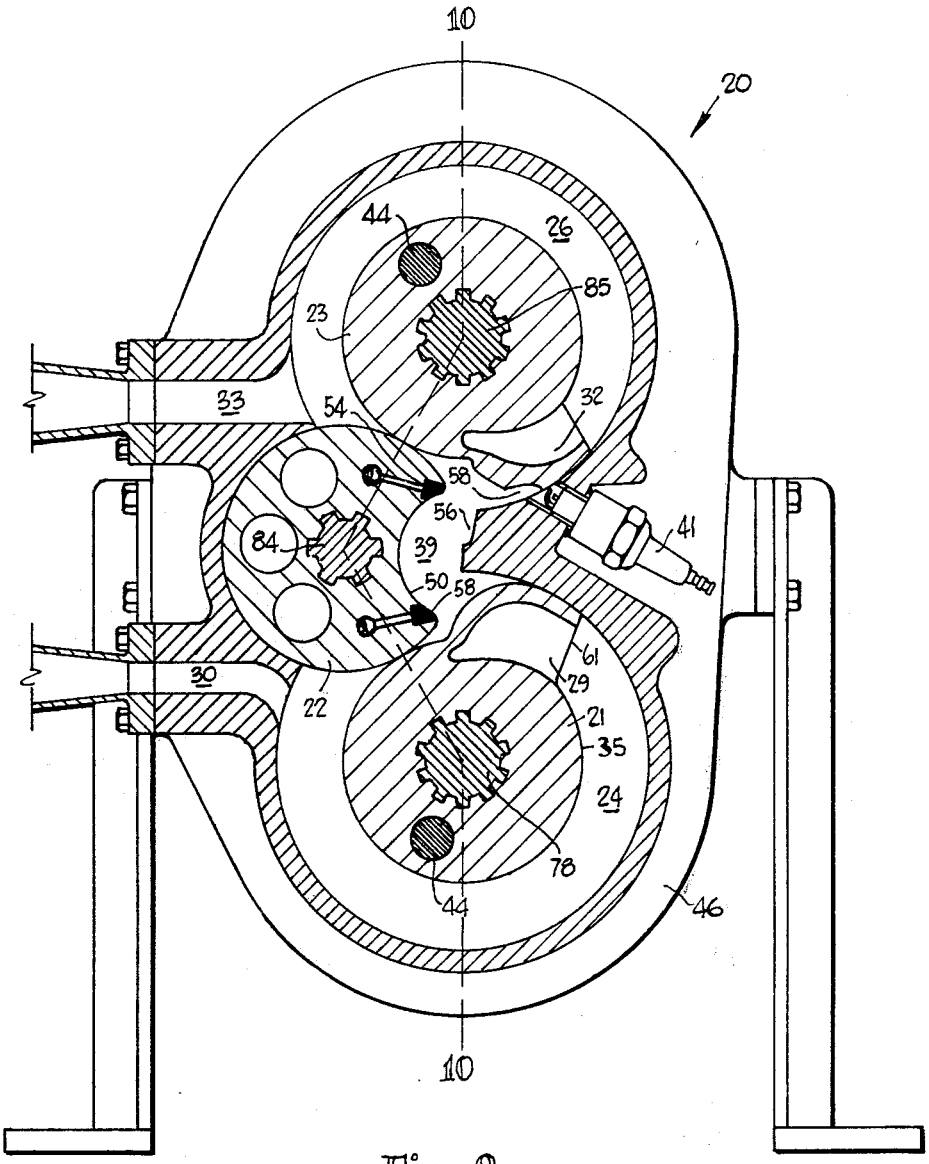
FIG. 9 is a cross-sectional view of an engine constructed according to the invention.
Figure 10:
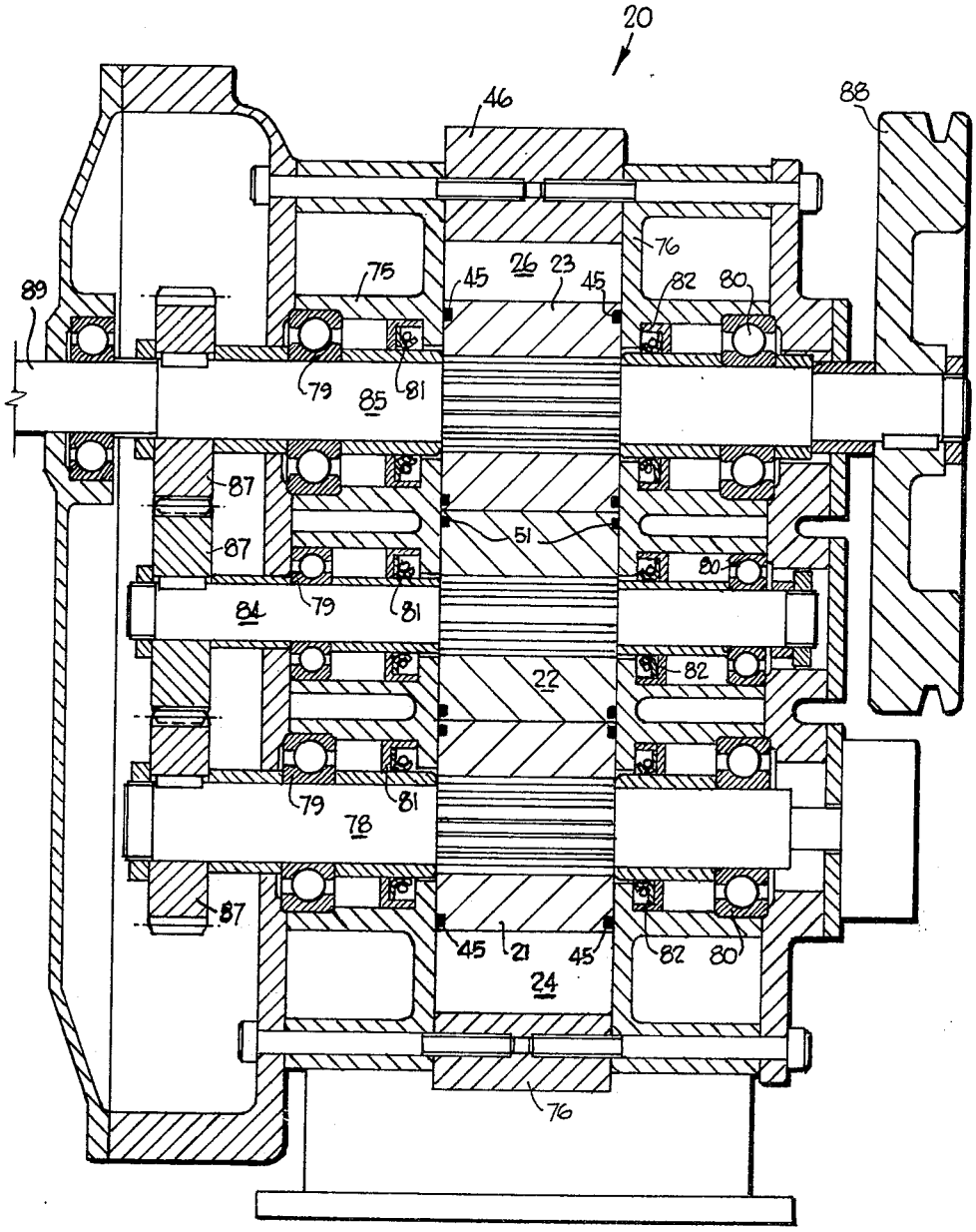
FIG. 10 is an elevational section taken on line 10—10 of FIG. 9.
Figure 11:
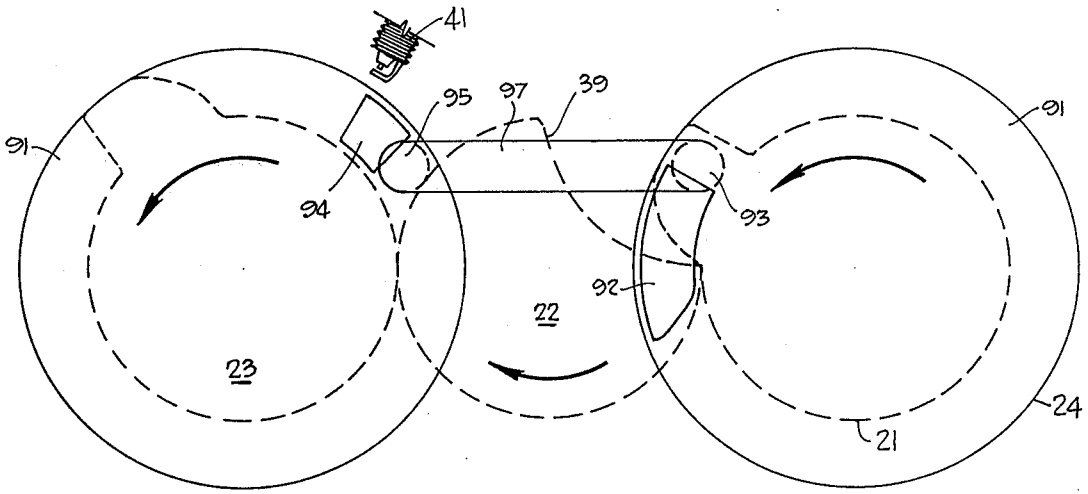
FIG. 11 is a diagrammatic representation of a machine wherein gas transfer from the compression cylinder to the combustion cylinder takes place through an external conduit, and not through the recess in the intermediate rotor.

The first embodiment of the invention is illustrated in FIGS. 1 through to 6, and FIGS. 9 and 10. FIG. 7 and FIG. 8 are herein regarded as being applicable to the first embodiment, since they constitute only a minor variation. FIG. 11 is a diagrammatic representation of a second embodiment.

Referring first to FIGS. 1(*a*) to 1(*d*) which illustrates four stages in the cycle of the rotary engine, and engine designated 20 is provided with three parallel walled rotors 21, 22 and 23 rotating in respective intersecting cylinders 24, 25, 26; rotor 21 being a compression rotor in a cylinder 24; rotor 22 being an intermediate gas transfer rotor in an intermediate cylinder 25; and rotor 23 being combustion rotor in a combustion cylinder 26. Rotors 21 and 23 may also be regarded as rotating pistons. In FIG. 1 (*a*) a compression rotor lobe 29 (which is hollow) is rotating anti-clockwise and has past an inlet port 30 thereby inducing a gas charge into the compression cylinder 24 but behind the trailing edge of rotor 29. At the same time the combustion lobe 32 is driving exhaust gases from the previous cycle outwardly through an exhaust port 33. A previously induced charge is in front of the leading edge of the compressor lobe 29, and the rolling surface designated 35 of the compression rotor 21 is in gas sealing contiguity with the rolling surface designated 36 of the gas transfer rotor 22. The rolling surface 37 of the combustion rotor 23 is also in gas sealing contiguity with the rolling surface 36 of the gas transfer rotor 22. The rolling surfaces are shown as smooth cylindrical surfaces but may in some embodiments comprise involute teeth meshing with each other.

As shown in FIG. 1 (*b*) the charge being compressed by the leading face of the compression lobe 29 is about to commence transferring through the gas transfer recess 39 in the gas transfer rotor 22, and as shown in FIG. 1 (*c*) the charge passes into the combustion cylinder 26 behind the trailing surface of the combustion rotor lobe 32. When transfer from the compression cylinder to the combustion cylinder is nearly complete, spark plug 41 is energised and the gas is ignited to impart a thrust against the rear face of the combustion lobe 32. As shown in FIG. 1 (*d*), at the end of combustion the combustion rotor lobe 32 enters the gas transfer recess 39 (expelling gases therefrom), the combustion cylinder then being filled with the gaseous products of combustion at atmospheric pressure. The next rotation of the combustion rotor 23 drives the gas outwardly forwardly of the front face of lobe 32 as described above.

Figure 1A:
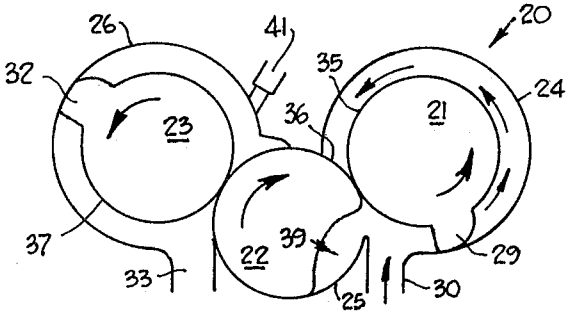
FIG. 1 is a diagrammatic representation illustrating the cycle of a machine when used as a rotary engine.
Figure 1B:
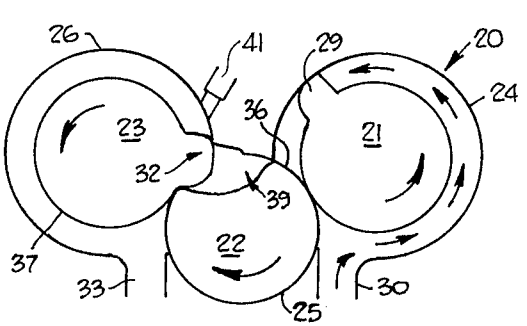
Figure 1C:
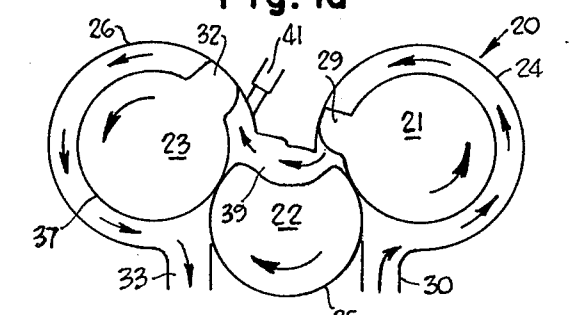
Figure 1D:
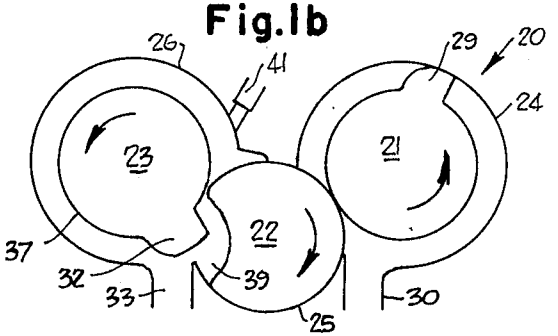
Figure 2:
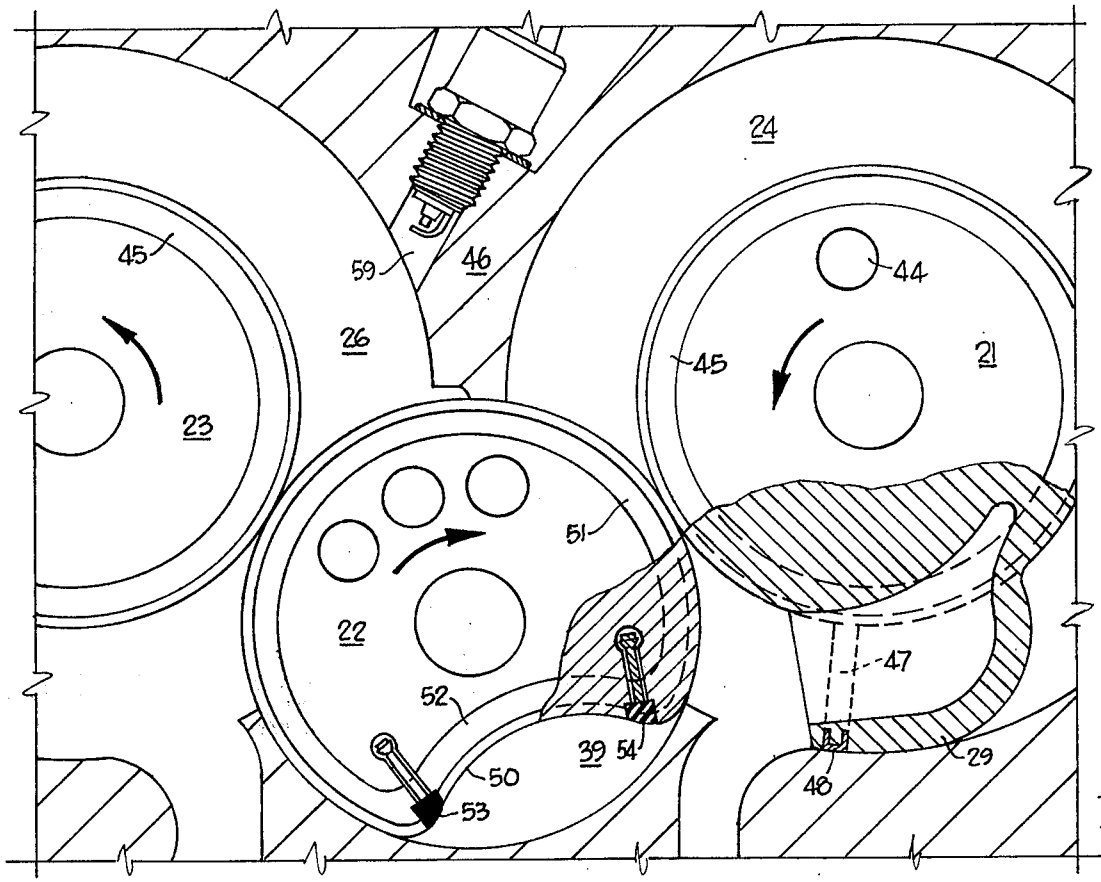
FIG. 2 is a diagrammatic drawing but to an enlarged scale showing inter-relationship of the rotors at the commencement of induction (and corresponding to (*a*) of FIG. 1)

FIG. 2 illustrates the stage otherwise illustrated in FIG. 1 (*a*) but in more accurate detail. The compression rotor 21 contains a lead plug 44 opposite the lobe 29 so as to counter-balance the lobe 29. The lobe 29 itself is hollow as illustrated in FIG. 2 so as to reduce the extent of counter-balancing needed. Each end face of the rotor 21 is provided with an annular seal designated 45 and these seals bear against end faces of the engine stator designated 46. Two short radially extending seal strips 47 (shown dotted in FIG. 2) flank respective sides of the lobe 29 to seal the lobe, and these seal strips 47 inter-leave at their outer ends with an axially extending seal strip 48 which engages the curved cylindrical surface of the compression cylinder 24. The combustion rotor 23 is provided with similar sealing rings and strips which are similarly numbered for the sake of simplicity.

The intermediate gas transfer rotor 22 is provided with a gas transfer recess 39 the arcuate length of which (defined as the arcuate projection of the gas transfer rotor rolling surface interrupted by the recess) exceeds radial depth. The rotor 22 contains holes opposite recess 39 for dynamic balancing. The surface 50 of the recess 39 is curved as illustrated in FIG. 2 (but not necessarily symmetrically), the shape of curvature being described hereunder. An arcuate shaped sealing strip 51 extends around each side face of the gas transfer rotor 22, and the ends of the strips 51 each being interleaved with curved side strips 52, and also with axially extending strips 53 and 54 which open into the recess 39 near its leading and trailing edge respectively. The function of these strips is described hereunder.

Figure 3:
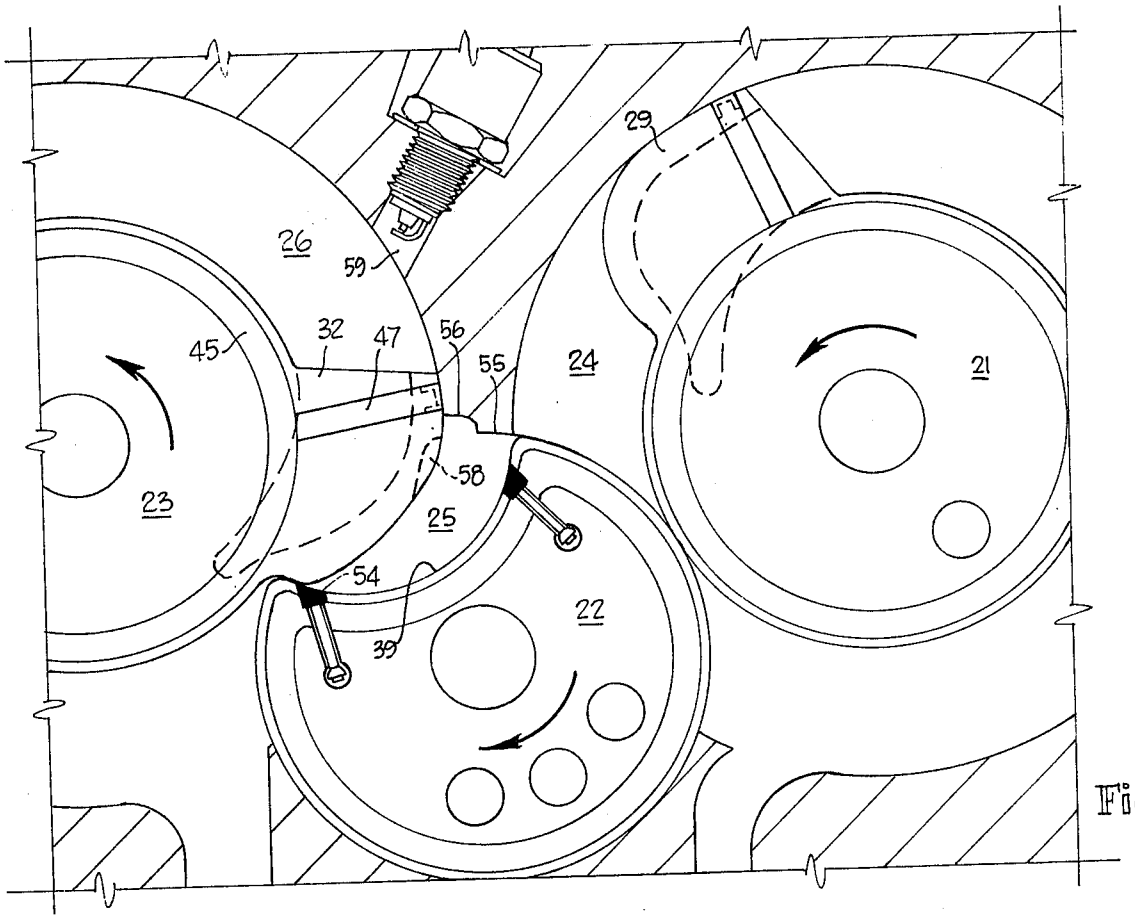
FIG. 3 is a drawing corresponding to FIG. 2 but showing a further stage in rotation (also illustrated as (*b*) in FIG. 1), wherein gas transfer commences from the compression to the combustion cylinder.

FIG. 3 corresponds with FIG. 1(*b*) in the cycle, and illustrates commencement of gas transfer from the compression cylinder 24, firstly into the recess 39, and upon further rotation, through the recess 39 in the gas transfer rotor 22 and into the combustion cylinder 26. The combustion rotor lobe 32 is of hollow section similar to the lobe 29. The rolling surface of the intermediate rotor 22 engages the walls of the intermediate cylinder 25. Although described as a cylinder, the cylindrical walls 25, as shown best in FIG. 3, comprise two relatively small arcuate portions which however lie in a continuous cylinder. The length of the uppermost arcuate portion is designated 55 and is adjusted (during design) by means of a relief surface 56 to assist in the control of gas transfer in volume and time. The trailing axially extending sealing strip designated 54 sealably engages the trailing surface of the combustion rotor lobe 32, and continues to engage the surface until such time as the rolling surfaces of the intermediate rotor 22 and combustion rotor 23 move into gas sealing contiguity. The radial outer surface of the lobe is also contiguous with the stator cylinder. In a position prior to that illustrated in FIG. 3, the leading face of the combustion lobe 32 displaced exhaust gas remaining in the recess 39 of the intermediate rotor 22.

Figure 4:
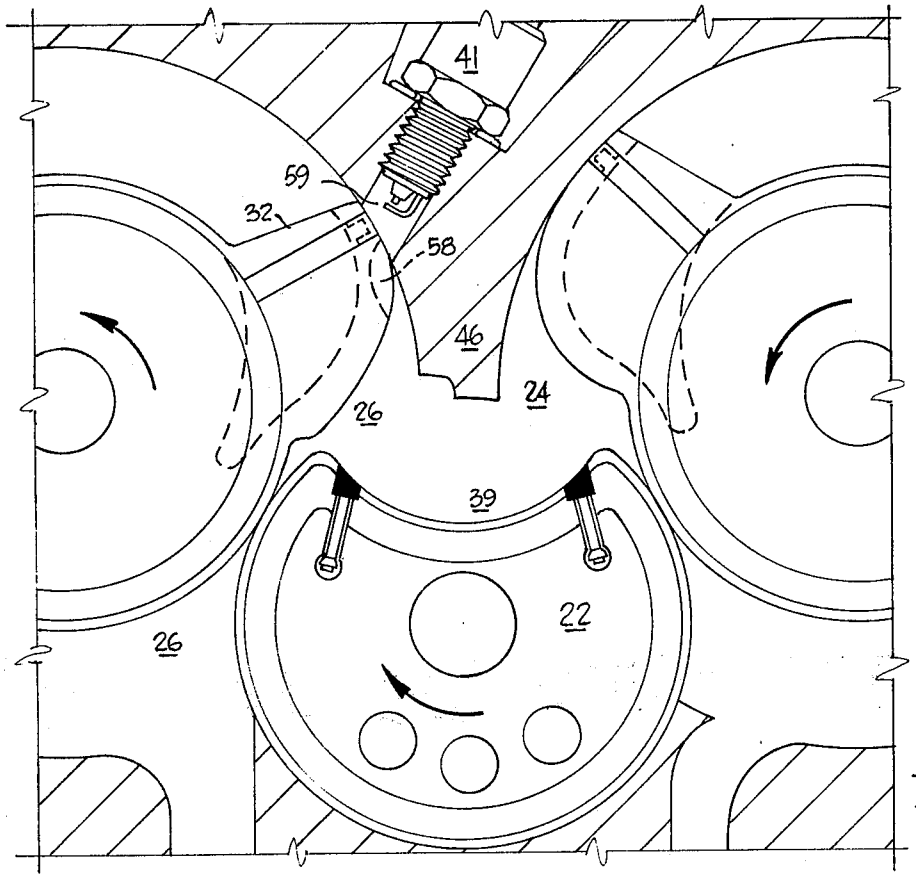
FIG. 4 shows a drawing corresponding to FIG. 2 wherein gas transfer is taking place (also illustrated at (*c*) in FIG. 1), 20% of rotation before entry of the compression lobe into the gas transfer recess.

When gas transfer rotor 22 is in the position illustrated in FIG. 4, the relatively large gas transfer recess 39 is in the position where gas readily flows from the compression cylinder 24, through recess 39 and into the combustion cylinder 26. A small narrow groove designated 58 and illustrated by the dotted line in the combustion rotor lobe 32 in FIG. 4 allows a very small amount of gas to pass through a threaded aperture 59 in the stator 46 which contains the spark plug 41, this "fresh" gas purging the previously burnt gases from the space surrounding the spark plug points so that ignition is readily attained.

Figure 5:
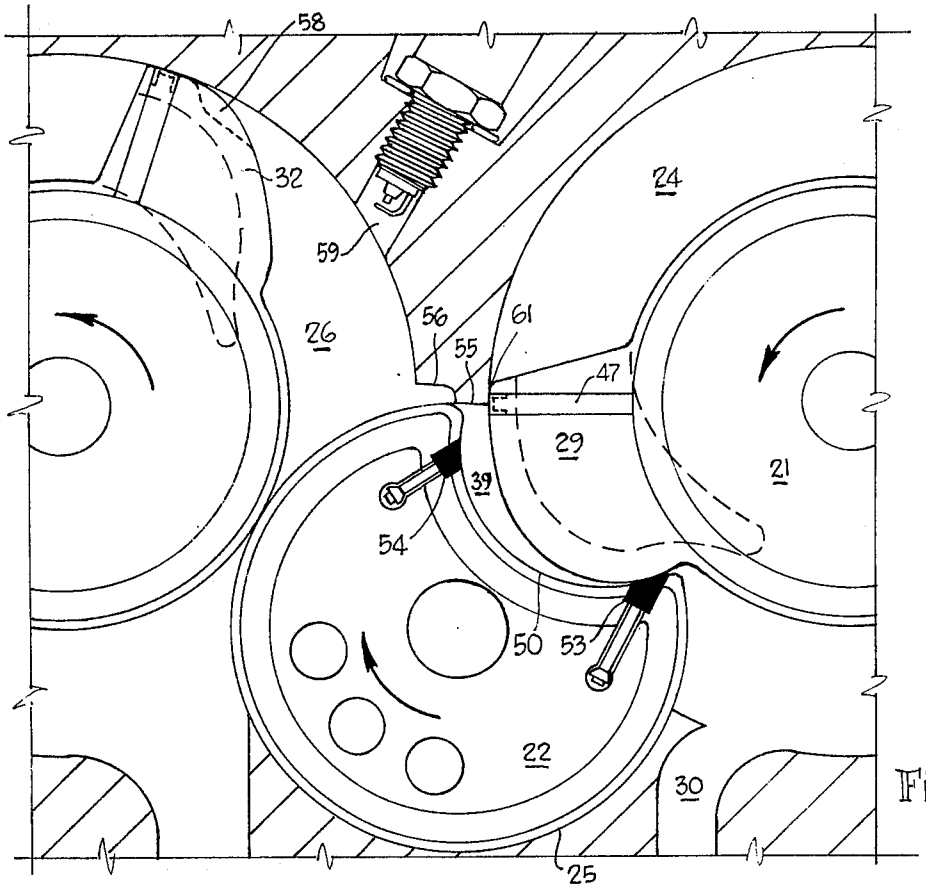
FIG. 5 is a further drawing similar to FIG. 2 but showing a further stage wherein transfer of gases is about to terminate, and illustrating also the gas entrapped between the proximate surfaces of the compression lobe and recess.
Figure 6:
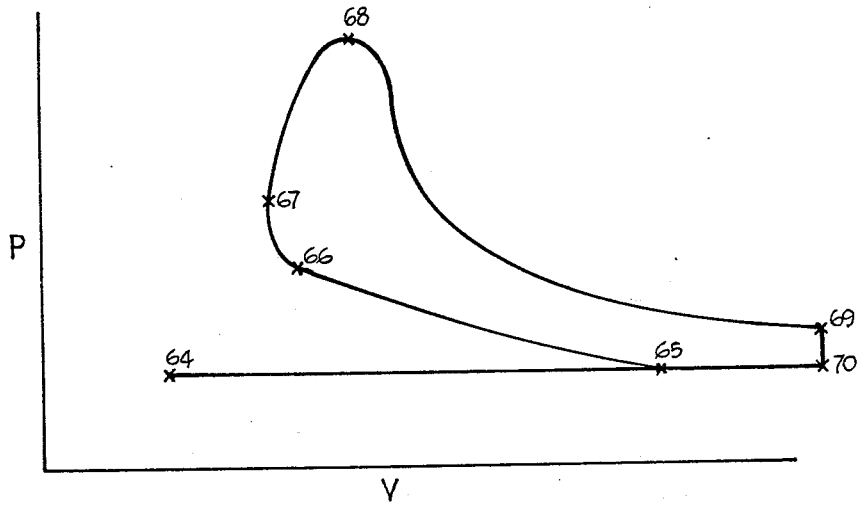
FIG. 6 is a Pressure-Volume diagram showing the relationship between pressure and volume in the machine.

However ignition does not take place until the stage which is illustrated in FIG. 5 is approached. In FIG. 5 the trailing edge of the surface 50 of recess 39 is about to contact the arcuate portion 55 of the intermediate cylinder 25 at a location where the three cylinders 24, 25 and 26 intersect. Only that small amount of gas remaining between the recess walls and the leading and radially outer walls of the compression rotor lobe 29 are not transferred. The leading and radially outer walls of the compression rotor lobe 29 move into close proximity with the walls of the recess 39, being of approximately complementary cross-sectional shape as illustrated best in FIG. 5. The small amount of entrapped gas (maintained at a minimum due to the shapes of the surfaces of the lobe 29 and recess 39) is still further compressed to a minor degree in the position shown in FIG. 5 and in a further position slightly in advance thereof, the entrapped gas is released past the trailing edge 61 of the lobe 29 into the induction space trailing the lobe 29 of the compression cylinder 24. The leading seal 53 engages the leading surface of the lobe 29 before the rolling surface of rotors 21 and 22 move away from each other, and prevent the entrapped gases being released in the direction of the inlet port 30. The seal 53 remains in engagement with the lobe surface until after its trailing edge moves away from the cylinder 24 (about five degrees advanced from the position of FIG. 5). It will be appreciated that the induction stroke is nearly completed at the position shown in FIG. 5, and therefore the gas in the induction space of cylinder 24 will be at a lower pressure than the gas at the inlet port 30, and will be moving towards compression lobe 29. Consequently the small amount of gas released from the trapped space will have little or no deleterious effect on the induction of gases. It will further be seen that the further the relief 56 moves across the arcuate portion 55, the less the amount of trapped gas, but this position must also satisfy other design requirements, and FIG. 6 illustrates the pressure/volume diagram of the engine. It will be noted that this varies considerably from the pressure/volume diagram of the ordinary piston engine. Induction is represented as commencing at point 64 and continuing to point 65. The latent heat of evaporation of the fuel keeps the compression cylinder 24 cool. This in turn allows maximum amount of gas to be induced since it is not expanded due to heating of the compression chamber. The gas charge is then compressed up to point 66 and at point 66 the relatively cool compressed charge is transferred to the relatively hot combustion cylinder 26, and as a result the pressure increases without any mechanical work being done since the heat comes from the hot combustion cylinder. This compression is illustrated by the line 66–67, and at point 67 ignition takes place. The pressure then increases rapidly up to point 68, followed by a long expansion of the charge down to point 69. At point 69 the exhaust port becomes uncovered and releases any residual pressure, being designated by the line 69–70, and the remaining gas is discharged at atmospheric pressure.

Several important features may be noted from a study of the ignition conditions. Since ignition takes place against a rapidly receding lobe face, detonation is substantially eliminated, and fuels may be used containing no "anti-knock" additives which are pollutants. The absence of a high "peak" on the pressure which otherwise exists in the piston engine means that the amount of oxide of nitrogen formed is trivial. Oxides of nitrogen are also pollutants. The conditions of expansion being favourable a "lean" mixture may be used to obtain higher efficiency than can be obtained with a piston engine, and emission of hydrocarbons can be substantially reduced.

Further it will be seen that the expansion takes place over a long arc of the cycle. In the example shown herein the lines 68–69 will be seen to represent about 250° of expansion. When compared with a piston engine, there is an immediate advantage due to the opening of the exhaust valve in a piston engine before bottom dead centre. This provides a considerable advantage.

However the length of the "tail" of FIG. 6 can be still further increased by the shaded area designated 72 in FIG. 8 less the shaded area designated 73 if the lobe 32 is slightly increased in length as shown in FIG. 7. The dotted line in FIG. 7 indicates the length of the lobe if the diameters of the combustion rotor 23 and compression rotor 21 are the same and the diameters of the respective cylinders are the same. But the compression volume and expansion volume need not be the same, and by increasing the diameter of the combustion cylinder 26 as illustrated in FIG. 7 whereby an increase of 20% of volume is achieved, there is provided a still further increase in efficiency over a piston engine. There is a very slight loss (illustrated by the shaded area 73) due to the increase in the amount of gas which is trapped in the recess 39, owing to the need to deepen the recess to accommodate the deeper lobe 32. This loss is small compared with the gain designated 72 as illustrated in FIG. 8. A similar effect can be obtained by reducing the induction stroke.

It will be appreciated by those skilled in the art that the machine described above may be used as a single stage compressor with the compression cylinder 24 and intermediate cylinder 25 only, together with their respective rotors. However, by re-arranging the volumes and relative positions of the cylinders, and providing an external conduit between the compression cylinder 24 and the "combustion"cylinder 26, but placing the output of the conduit behind the trailing face of the lobe 32, an efficient two stage compressor is achieved. It will be also appreciated by those skilled in the art that the inlet port 30 need not necessarily be open direct to atmosphere but may itself be connected with a further compressor of the type illustrated herein, or of some other type, to super-charge the engine and thus to increase the maximum temperature which is attainable. By a combination of a super charging and increase in the expansion as illustrated in FIGS. 7 and 8 very high efficiencies can be achieved. Furthermore, complete dynamic and static balancing can also be achieved, and as illustrated it will be seen that the gas flow conduits and apertures are of generous proportion so that the machine can run at very much higher speeds than a piston engine. The engine thus embodies many of the advantages of a gas turbine with many of the advantages of a piston engine, achieving a higher efficiency than either. When the machine is run at very high speed there is no need for the seals illustrated herein.

Referring now to the detailed drawings of FIGS. 9 and 10, the engine 20 comprises the stator 46 which is formed from a flake-graphite ni-resist iron, identified by International Nickel Australian Limited, 406 Lonsdale Street, Melbourne, as Type 1 (Aus101A). This is a cast iron containing 15% nickel, 6% copper and 2% chromium and having a thermal expansion of 0.000019 per ° C. End plates are respectively designated 75 and 76 and are formed with the same material.

The combustion rotor 23 is formed from a type 3 (Aus 105) containing 30% nickel and 3% chromium, and having smaller thermal expansion rate of 0.000012 per ° C. In an experimental engine constructed in accordance with FIGS. 9 and 10 it was found that the working clearances remained substantially unaltered using this combination of materials.

The intermediate gas transfer rotor 22 is formed from a similar metal but Type 4 containing 30% nickel, 5% chromium and 5% silicon, and having an expansion of 0.000015 per ° C.

A different type of difficulty is encountered however with the compression rotor 21 since the latent heat of vapourising fuel maintains the compression rotor 21 cooler than the end plates 75, 76 or the stator 46. In this embodiment the compression rotor is formed of aluminium with an expansion ratio of 0.000023 per ° C.

The compression rotor is carried on a shaft designated 78 supported in bearings 79 and 80 in respective end plates, 75 and 76. It is also provided with seals designated 81 and 82 respectively the seals being fluoroelastomers and sold under the Trade Mark VITON 'A' (a Du Pont Trade Mark). Similarly the gas transfer rotor 22 is carried on a shaft designated 84 and the combustion rotor is carried on a shaft designated 85 these shafts being similarly carried in bearings and having seals which are designated the same as the bearings and seals for the shaft 78.

The respective shafts carry on them identical spur gears all of which are designated 87 and positioned outwardly of the end plates 75, so that the shafts all rotate at the same angular velocity, the two outer shafts moving in an anti-clockwise direction while the inner shaft moves in a clockwise direction. The shaft 85 carries on its other end (adjacent the end plate 76) a fly wheel designated 88, while the first end projects at 89 for the transmission of power.

As described with respect to FIGS. 2, 3, 4 and 5 all rotors are balanced and therefore are capable of being run at very high speed. The bearings are all fixed in the end plates, so that the centres of the shafts are fixed with respect to one another. The shafts subtend an angle of 120° but as shown hereunder this angle is not critical. The stator body is shown in this embodiment as being air cooled, but the stator covers are water cooled.

The space between the cylindrical surfaces of the rotors 21, 22 and 23 where they are contiguous is fixed at between 0.04 mm and 0.08 mm at ambient temperature for rotors having a 10 cm rolling diameter, and the space between the end plates (the total end play of the rotors) is fixed at about the same or slightly more, each side. It is found that with the materials referred to there is no substantial interference between the working parts due to heat, yet the working parts co-operate in a gas sealing contiguity, and in high speed engines this contiguity exists even if seals are not used.

It will be seen that a characteristic of the design of FIGS. 9 and 10 is the provision of large gas flow passages which also assist in causing high speed operation of the machine.

As said, in the first embodiment the shafts subtend between them an angle of 120° but the angle is not critical. In FIG. 11 the shafts all lie in a common plane, and the stator is wider to accommodate the three rotors 21, 22 and 23 which are shown dotted. The width is so great that the recess 39 (also dotted) is of less width than the spaces between the cylinders 24 and 26 as the recess moves from one cylinder to another so that the recess ceases to function as a gas flow path. In this embodiment one or both of the end plates 75 and 76 contains a pair of recesses, each recess containing a respective disc 91 which is secured to the outer end of a respective rotor 21 or 23, the compression disc 91 having an elongate slot 92 which uncovers a transfer port 93 while the combustion disc 91 has a relatively short slot 94 which uncovers a transfer port 95 in the side wall and opening into the cylinder 26. An external conduit designated 97 extends between the two ports 93 and 95, and the compressed charge from the compression cylinder 24 is transferred through the conduit 97, the two ports 93 and 95 closing at about the same time firing takes place from the spark plug 41. Any untransferred charge remains in the conduit 97 until the next cycle. However it remains a characteristic that the compression lobe and gas transfer recess are of such complementary shape that the compression lobe more than half fills the recess while the rolling surfaces of rotors 21 and 22 remain in gas-sealing contiguity, so that the amount of entrapped gas remains at a minimum.

In some other examples of the invention use can be made of both a transfer conduit 97 and also the recess 39 as a gas transfer path in parallel with the conduit 97. The machine lends itself to simple configurations for multiple cylinder devices, further stators merely being aligned in an axial direction, and the rotors of any one stator being displaced angularly with respect to the corresponding rotors of another stator to provide equal firing intervals. Alternatively, the stators may be tiered and the rotors geared together.

We claim:

1. A rotary machine having a plurality of rotors rotatable within respective parallel intersecting bores in a stator, at least one of said rotors being a compression rotor and having an axially extending lobe radially outstanding from a rolling surface, which upon rotation sealably co-operates with the curved surface of its respective said bore, another said rotor being a gas transfer rotor and having a rolling surface in gas-sealing contiguity with the curved surface of its respective bore and containing an axially extending gas transfer recess which extends radially inward from its rolling surface, the gas transfer bore curved surface having an arcuate portion near the intersection of the bores, drive means coupling the compression rotor to rotate in one direction and the gas transfer rotor to rotate in the opposite direction, the axes of the rotors being arranged so that, upon rotation, the recess surface is entered by said compression lobe, and when the compression lobe is not within the recess, the rolling surface of the compression rotor lies in gas-sealing contiguity with the rolling surface of the gas transfer rotor, the compression lobe and the gas transfer recess being of such complementary shape that at a first position during rotation, the compression lobe more than half fills the recess while its trailing portion is still contiguous with its bore, and the leading face of the compression lobe remains in gas-sealing contiguity with the leading surface of the recess, after said rolling surfaces have separated, the circumferential length of said arcuate portion and the recess size being such that the leading portion of the transfer rotor rolling surface is in gas-sealing contiguity with the arcuate portion while at a second position slightly advanced of said first position, no gas-sealing contiguity exists between said lobe trailing portion and the compression rotor bore or the recess surface while said gas-sealing contiguity between the transfer rotor rolling surface and the arcuate portion is maintained, such that any compressed gas contained in said recess enters the compression rotor bore only past said lobe trailing portion.

2. A rotary machine according to claim 1 wherein, in said first position, said arcuate portion, the compression lobe surfaces and the recess surfaces define a gas containing space having a volume much smaller than the volume defined between the recess walls and an arcuate projection of the gas transfer rotor surfaces.

3. A rotary machine according to claim 1 wherein there are three rotors rotatable in said respective parallel intersecting bores, the third said rotor being a combustion rotor also having a rolling surface and an axially extending lobe radially outstanding from the rolling surface, which upon rotation, sealably cooperates with the curved surfaces of the combustion bore, and enters said gas transfer recess, said drive means also coupling the combustion rotor to rotate in the same direction as the compression rotor, an inlet port opening into the compression rotor bore, and an outlet port opening into the combustion rotor bore.

4. A rotary machine according to claim 3 wherein the combustion lobe is of such dimension that, upon rotation, the combustion lobe passes from the recess and into gas-sealing contiguity with the combustion bore surface and with the transfer rotor surface, while a trailing portion of the rolling surface of said gas transfer rotor still remains in gas-sealing contiguity with said arcuate portion of the gas transfer bore near the intersection of the bores so that upon further rotation the trailing face of said combustion lobe, the leading face of said compression lobe and the surface of said recess confine gas during transfer from the compression bore to the combustion bore.

5. A rotary machine according to claim 3 wherein the stator contains the inlet port opening into said compression bore at a locality circumferentially spaced from said arcuate portion of the gas transfer bore and further contains the outlet port opening into the combustion bore at another locality which is also circumferentially spaced from said arcuate portion.

6. A rotary machine according to claim 3 wherein all said bores are cylindrical and all said rolling surfaces are also cylindrical.

7. A rotary machine accordig to claim 3 wherein each said lobe has a hollow cross-sectional configuration.

8. A rotary machine according to claim 3 further comprising a threaded aperture in said stator opening into said combustion bore near said arcuate portion and containing a spark plug, and a recess in the outer surfaces of said combustion lobe extending circumferentially part-way along the lobe from its trailing edge and axially aligned with said threaded aperture, thereby being operable to pass some gas through the inner end of said aperture during said gas transfer and thus purge said aperture of burnt gases.

9. A rotary machine according to claim 3 wherein all said bores are cylindrical, said compression and combustion cylinders are of equal diameter and all said rolling surfaces are of equal diameter.

10. A rotary machine according to claim 3 wherein all said bores are cylindrical, and the combustion cylinder diameter is greater than the compression cylinder diameter.

11. A rotary machine according to claim 5 wherein the stator walls contain recesses and discs are secured one on each of the corresponding ends of the compression and combustion rotor and rotate with gas sealing contiguity and within said recesses, there being a respective port in each of the recesses and an aperture in each disc alignable with its respective port, and a conduit connecting a compression bore port and the combustion bore port, said drive means being so phased that both ports are uncovered by the disc apertures and at the conclusion of the compression but before commencement of combustion and together with the conduit form portion of the gas transfer passage between the leading face of the compression rotor and the trailing faces of the combustion rotor.

12. A rotary machine according to claim 3 further comprising seals in respective end faces of each of said rotors bearing against contiguous end faces of the engine stator; an axially extending seal strip in each lobe sealably engaging the respective bore; and a pair of axially extending seal strips in the gas transfer recess located near respective leading and trailing edges thereof.

* * * * *